US005357915A

United States Patent [19]

Yamamoto et al.

[11] Patent Number: 5,357,915

[45] Date of Patent: Oct. 25, 1994

[54] VALVE SYSTEM FOR INTERNAL COMBUSTION ENGINE

[75] Inventors: Toshio Yamamoto, Tokyo; Seishi Miura; Koji Takamatsu, both of Saitama, all of Japan

[73] Assignee: Honda Giken Kogyo Kabushiki Kaisha, Tokyo, Japan

[21] Appl. No.: 942,676

[22] Filed: Sep. 9, 1992

[30] Foreign Application Priority Data

Sep. 10, 1991 [JP] Japan ..... 3-229896
Dec. 3, 1991 [JP] Japan ..... 3-318870

[51] Int. Cl.[5] ..... F01L 1/34

[52] U.S. Cl. ..... 123/90.16; 123/90.17; 123/90.31

[58] Field of Search ..... 123/90.15, 90.16, 90.17, 123/90.27, 90.31

[56] References Cited

U.S. PATENT DOCUMENTS 4,535,733 8/1985 Honda ..... 123/90.17
4,552,112 11/1985 Nagao et al. ..... 123/90.17
4,580,533 4/1986 Oda et al. ..... 123/90.16
4,582,029 4/1986 Masuda et al. ..... 123/90.16
4,592,310 6/1986 Hitomi et al. ..... 123/90.17
4,617,882 10/1986 Matsumoto ..... 123/90.31
4,651,684 3/1987 Masuda et al. ..... 123/90.16
4,671,223 6/1987 Asano et al. ..... 123/90.31
5,074,260 12/1991 Yagi et al. ..... 123/90.16
5,107,802 4/1992 Yagi et al. ..... 123/90.15

FOREIGN PATENT DOCUMENTS 3130510 6/1991 Japan .

*Primary Examiner*—E. Rollins Cross
*Assistant Examiner*—Weilun Lo
*Attorney, Agent, or Firm*—Lyon & Lyon

[57] ABSTRACT

A valve system for an internal combustion engine capable of changing the valve timing and valve lift of the intake and exhaust valves driven by rocker arms and overhead camshafts. A cam support member is pivotally mounted to the engine head and is positioned by a gear segment mounted to the camshaft support member in combination with a drive including a worm gear and a servomotor located on an engine block. The camshafts are driven by the crankshaft coupled with an idler gear. The idler gear is coupled with the camshaft gears through reduction gears, reducing the overall size of the drive and allowing flexibility as to valve timing.

16 Claims, 18 Drawing Sheets

VALVE SYSTEM FOR INTERNAL COMBUSTION ENGINE

BACKGROUND OF THE INVENTION

The field of the present invention is valve drive systems capable of changing valve timing and valve lift.

Mechanisms have been known for varying valve timing and valve lift during engine operation. One such device is disclosed in Japanese Patent Laid Open No. Hei-3-130510. A camshaft support member is pivotally mounted to a head about a rocking axis. The camshafts mounted thereby engage rocker arms which in turn engage poppet valves. The rocker arms are pivotally mounted to the head such that movement of the camshaft support member about the rocking axis changes the point of engagement of the camshafts mounted thereto with the rocker arms. Associated with the upper portion of the camshaft support member is a gear segment. Mounted to the head cover is a worm gear and servomotor. The worm gear meshes with the gear segment on the camshaft support member to operatively position same.

Cam gears fixed to each camshaft move with the camshaft support member in the aforementioned device. Rotatably mounted to the head about the rocking axis is an idler gear engaging the cam gears. With rocking of the camshaft support member, the valve timing is changed. The cam gears are driven by the crankshaft with the cam gears rotating at half the speed of the crankshaft. Given the necessary driving ratio, given the need to place the center of the idle gear at the rocking axis and given the relative displacement of the cams from that axis, limitations are placed on the size and flexibility of the drive components.

The prior system, with the drive mechanism for the camshaft support member is mounted in the valve cover and with the limitations on the configuration for the cam drive have required compromises. The head cover cannot be loosely supported on the cylinder head. This allows the noise of the engine to be transmitted through the head cover and a larger head cover is required with a corresponding increase in height of the engine. The limitations on the camshaft drive system also can result in a larger overall structure and limitations on design freedom in terms of valve timing variations with valve lift control.

SUMMARY OF THE INVENTION

The present invention is directed to a valve system for an internal combustion engine which provides valve lift and timing control in an advantageous design.

In a first aspect of the present invention, a valve system for an internal combustion engine is provided which is capable of changing the valve timing and valve lift of valves driven by rocker arms through the rocking of a camshaft support member about a rocking axis on the cylinder head. The camshaft support member is driven by a drive system mounted close to the rocking axis to the structural components of the engine such as the cylinder block rather than to the valve cover. This allows the use of a more conventional valve cover and greater design freedom.

In a second aspect of the present invention, a valve system for an internal combustion engine is contemplated which is capable of changing the valve lift and valve timing by means of a camshaft support member which may be rocked about a rocking axis on the engine head. A cam drive includes an idler gear, cam gears associated with each cam and intermediate reduction gears engaged by the idler gear and engaging the cam gears. This allows greater design freedom in determining the size of the cam drive and in selecting the relationship between variations in valve lift and variations in timing advance.

In a third aspect of the present invention, a valve system for an internal combustion engine is provided which is capable of changing the valve timing and valve lift of valves driven by rocker arms through the rocking of a camshaft support member about a rocking axis on the cylinder head. The camshaft support member is driven by a drive system mounted close to the rocking axis to the structural components of the engine such as the cylinder block rather than to the valve cover. A position sensor is coupled with the camshaft support and a pin and slot linkage is employed to have the output of the position sensor approximate valve lift.

Therefore, it is an object of the present invention to provide an improved system for operating valves in an internal combustion engine with variations in valve timing and lift. Other objects and advantages will appear hereinafter.

DETAILED DESCRIPTION OF THE PREFERRED EMBODIMENTS

Figure 1:
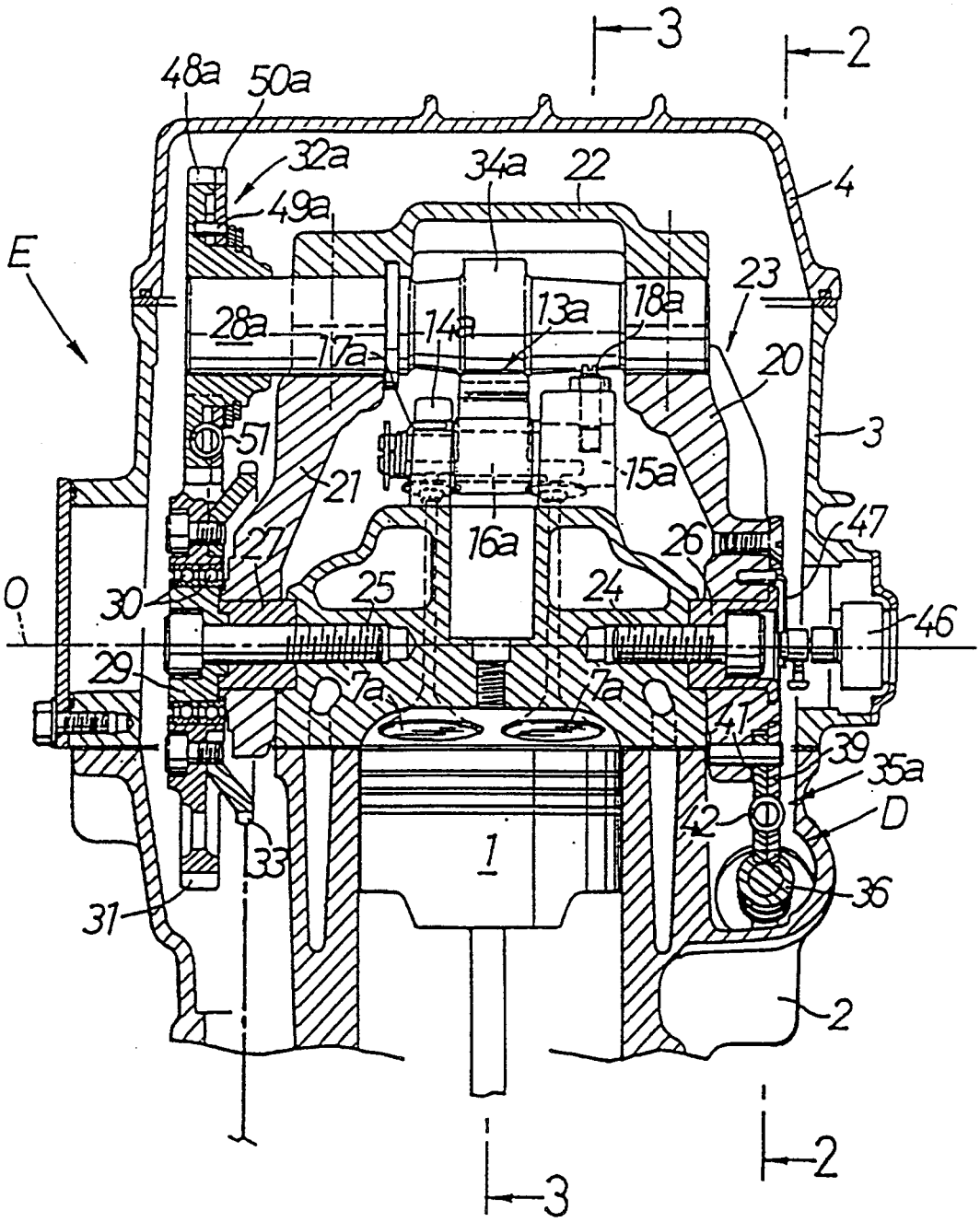
FIG. 1 is a longitudinal cross-sectional view of a cylinder head portion of an internal combustion engine which is a cross-sectional view taken along line 1—1 of FIG. 3.
Figure 2:
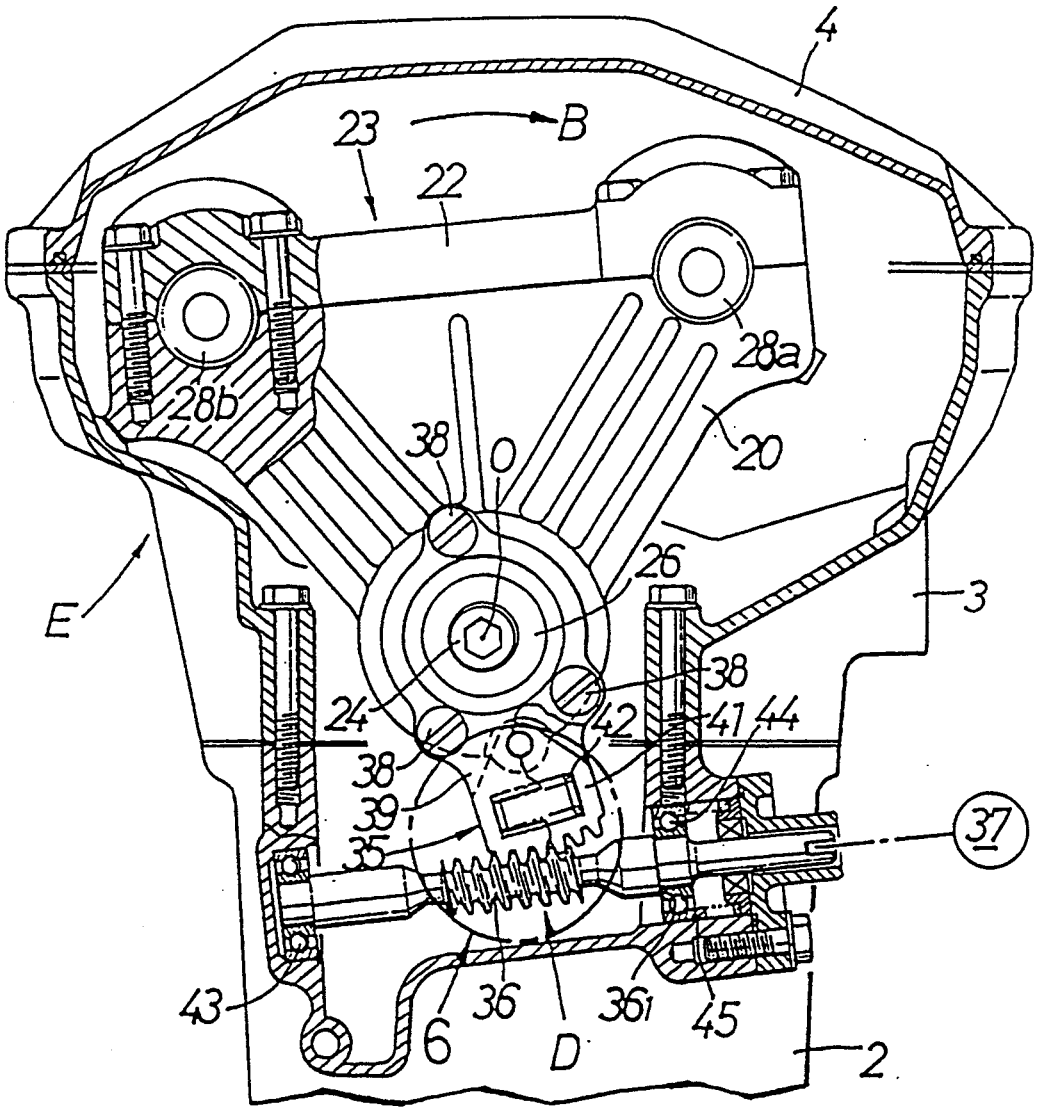
FIG. 2 is a cross-sectional view taken along line 2—2 of FIG. 1.
Figure 3:
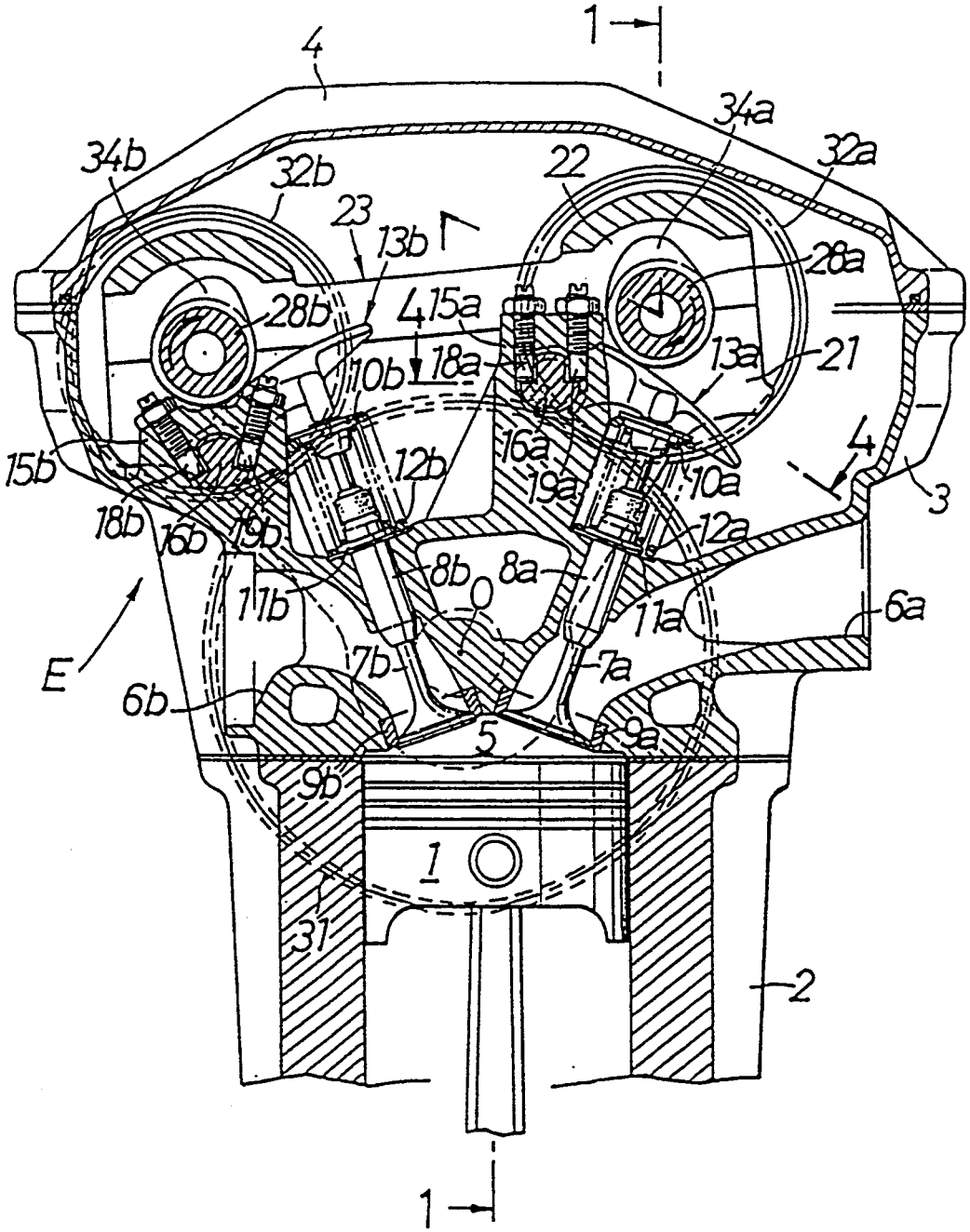
FIG. 3 is a cross-sectional view taken along line 3—3 of FIG. 1.

Referring now to FIGS. 1 to 3, a four-cycle double overhead cam internal combustion engine includes a cylinder head 3 joined onto the upper portion of a cylinder block 2 containing a slidable piston. A head cover 4 is joined onto the upper portion of the cylinder head 3.

The cylinder head 3 contains a combustion chamber 5 facing the top surface of a piston 1. A pair of intake ports 6*a* and a pair of exhaust ports 6*b* to the combustion chamber 5 are mounted with intake valves 7*a* and exhaust valves 7*b*, respectively. The intake valves 7*a* and exhaust valves 7*b* are slidably supported by valve guides 8*a* and 8*b*. They are energized upwardly by valve springs 12*a* and 12*b* contractively positioned between upper retainers 10*a* and 10*b* and lower retainers 11*a* and 11*b* for seating the tappet portions of the valves 7*a* and 7*b* on valve seats 9*a* and 9*b*, respectively. With this arrangement, the upper ends of shaft portions of the valves 7*a* and 7*b* are respectively abutted on an intake rocker arm 13*a* and an exhaust rocker arm 13*b*, to be driven thereby.

Figure 4:
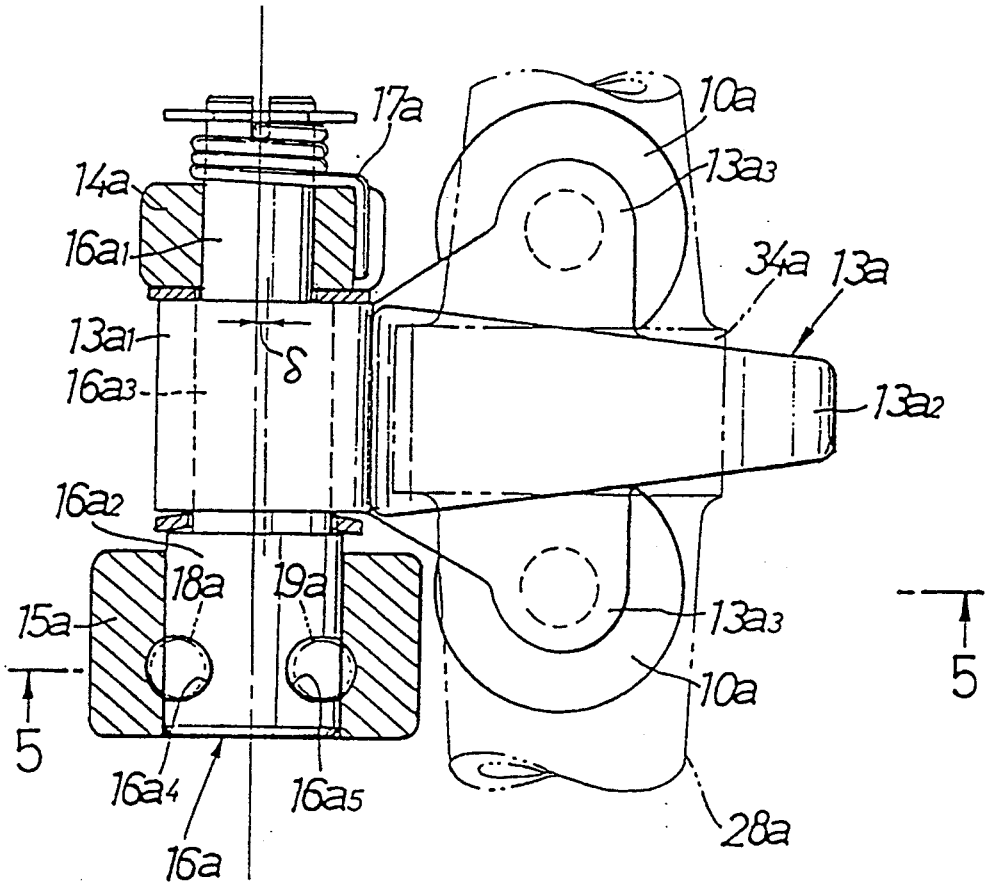
FIG. 4 is a cross-sectional view taken along line 4—4 of FIG. 3.
Figure 5:
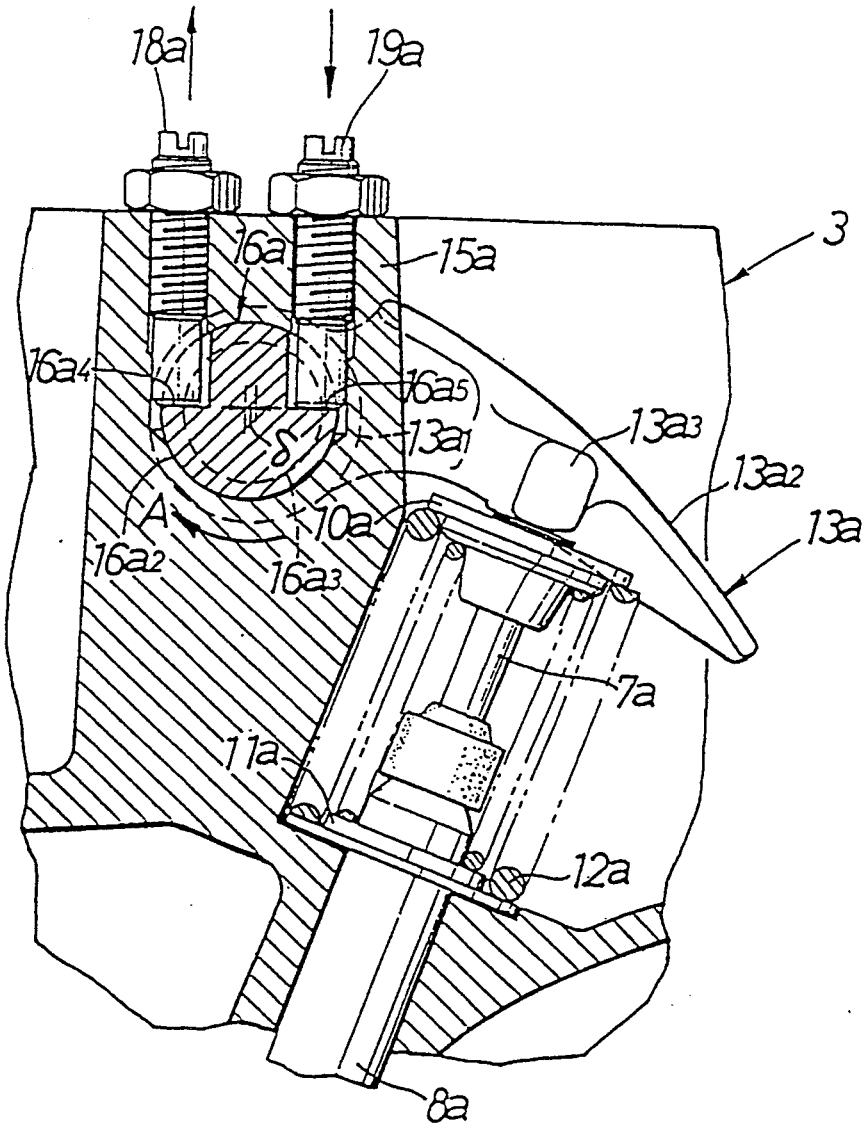
FIG. 5 is a cross-sectional view taken along line 5—5 of FIG. 4.

In FIGS. 4 and 5 the intake rocker arm 13*a* is rotatably supported by an intake rocker arm shaft 16*a* composed of an eccentric shaft installed between a pair of brackets 14*a* and 15*a* provided on the cylinder head 3. The intake rocker arm 13*a* is composed of a slipper arm $13a_2$ extending from a boss portion $13a_1$ fitted around the outer periphery of the intake rocker arm shaft 16*a*, and a pair of right and left valve drive portions $13a_3$ formed integrally with a slipper arm $13a_2$ and abutted on the upper end of the above-mentioned intake valves 7*a*.

The rocker arm shaft 16*a* includes a small diameter portion $16a_1$ rotatably supported by the one bracket 14*a*, a large diameter portion $16a_2$ formed coaxially with the small diameter portion $16a_1$ and rotatably supported on the other bracket 15*a*, and an eccentric portion $16a_3$ formed eccentrically with the small diameter portion $16a_1$ and a large diameter portion $16a_2$ by a value of 6 for supporting the rocker arm 13*a*. The rocker arm shaft 16*a* is energized in the direction of the arrow A by a coil spring 17*a* mounted between the bracket 14*a* and the same. Two adjusting bolts 18*a* and 19*a* are screwed downwardly from the upper surface of the bracket 15*a* until the extreme ends thereof are abutted on two cutouts $16a_4$ and $16a_5$formed on the large diameter portion $16a_2$ of the eccentric shaft 16*a*. Accordingly, by loosening one of the two adjusting bolts 18*a* and 19*a* and tightening the other, it is possible to change the rotational position of the rocker arm shaft 16*a* through the cutouts $16a_4$ and $16a_5$. This changes the position of the boss portion $13a_1$ of the rocker arm 13*a* supported by the eccentric portion $16a_3$ in the vertical direction, thus enabling fine adjustment of a tappet clearance.

As is apparent from FIG. 3, the exhaust rocker arm 13*b* is substantially identical to the above-mentioned intake rocker arm 13*a* in its structure and supporting structure. Accordingly, parts are indicated at the same numerals each with a suffix of (b) and the overlapping explanation thereof is omitted. However, in the exhaust rocker arm 13*b*, the adjusting bolts 18*a* and 19*b* of the rocker arm shaft 16*a* are inclined upwardly for preventing interference with the exhaust camshaft 28*b* described later.

Turning now to FIGS. 1 to 3, a camshaft support member 23 is composed of a pair of triangle side plates 20 and 21, and a cam holder 22 connecting the upper ends of the side plates 20 and 21 with each other. The lower ends of the camshaft support member 23 are rotatably supported by boss members 26 and 27 fixed to the cylinder head 3 by bolts 24 and 25. The intake camshaft 28*a* and exhaust camshaft 28*b* are rotatably installed between the side plates 20 and 21 of the camshaft support member 23, respectively. An idler gear 31 is supported by a boss member 29 provided outside one boss member 27 so as to be coaxial therewith through a ball bearing 30, and is meshed with an intake side cam gear 32*a* mounted on the intake camshaft 28*a* and an exhaust cam gear 32*b* mounted on an exhaust camshaft 28*b*. The idler gear 31 is driven by a crankshaft through a chain meshed with a sprocket 33 fixed integrally with the idler gear 31. The intake cam 34*a* mounted to the intake camshaft 28*a* is abutted on the slipper arm $13a_2$ of the intake rocker arm 13*a*, while the exhaust cam 34*b* mounted to the exhaust camshaft 28*b* is abutted on the slipper arm $13b_2$ of the exhaust rocker arm 13*b*. In this case, each slipper surface of the slipper arms $13a_2$ and $13b_2$ of the rocker arms 13*a* and 13*b* is formed into a circular arc with respect to the rocking center 0 of the camshaft support member 23, that is, the rotational center of the idler gear 31.

Figure 6:
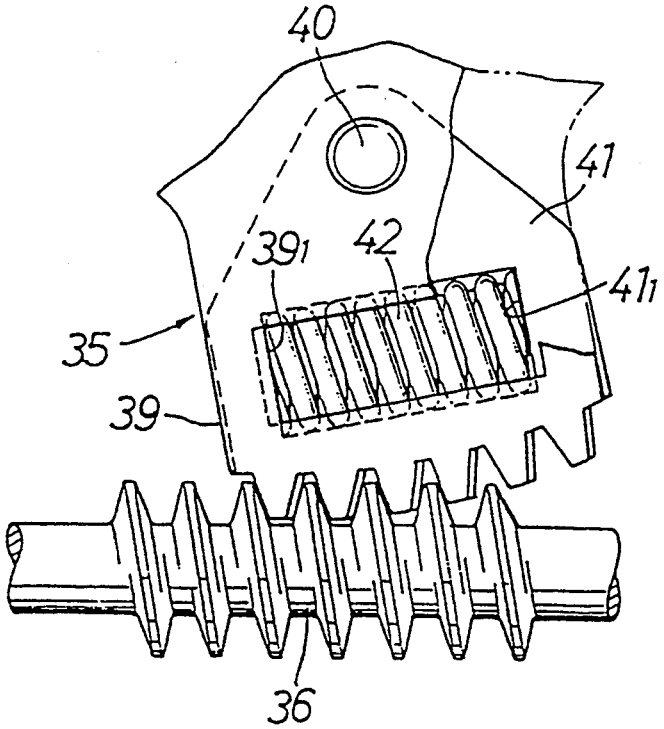
FIG. 6 is an enlarged view of a portion as indicated by circle 6 in FIG. 2.

In FIGS. 1 and 2, a rocking drive mechanism D includes a sector gear 35 provided outside one side plate 20 of the camshaft support member 23. The worm gear 36 meshed with the sector gear 35 is driven by a servomotor 37, and thereby the camshaft support member 23 is rocked around the rocking axis 0. Referring further to FIG. 6, the sector gear 35 is composed of a fixed gear 39 fixed on the lower portion of the side plate 20 by three bolts 38, and a movable gear 41 which is overlapped on the fixed gear 39 and pivoted by means of a pin 40. The fixed gear 39 and movable gear 41 are respectively formed with rectangular opening portions 391 and 411. A coil spring 42 is contractively provided within the interiors of the opening portions $39_1$ and $41_1$.

With this arrangement, the movable gear 39 is slightly rocked around the pin 40 with respect to the fixed gear 41, and consequently, respective tips of the gears 39 and 41 are energized so as to be deviated in the circumferential direction. This prevents occurrence of backlash between the sector gear 35 and the worm gear 36 meshed therewith. The worm gear 36 is supported by the cylinder block 2 through a pair of ball bearings 43 and 44. One ball bearing 44 is axially energized by a coil spring 45 to be brought in press-contact with a stepped portion $36_1$ formed on the worm gear 36. This eliminates an axial play of the worm gear 36, thereby reducing looseness of the rocking drive mechanism D in cooperation with elimination of the backlash mentioned above. Therefore, it is possible to accurately control valve lift and valve timing.

In FIG. 2, when the rocking drive mechanism D rocks the camshaft support member 23 in the direction of the arrow B, the worm gear 36 receives a right-to-left reaction force from the sector gear 35, thus exerting a compressive force to the coil spring 45. In this case, the movable gear 41 of the sector gear 35 is pushed by the worm gear 36 in the left direction, thereby also exerting a compressive force to the coil spring 42 of the sector gear 35 (refer to FIG. 6). However, when the camshaft support member 23 is rocked in the direction of the arrow B, the intake side cam 34*a* and exhaust side cam 34*b* are respectively close to the extreme end sides of the rocker arms 13*a* and 13*b* to reduce valve lift. Consequently, the load needed to rock the camshaft support member 23 in the direction of arrow B is made smaller than that needed to rock it in the direction reversed to arrow B. Accordingly, the load exerted on the coil springs 45 and 42 is relatively small, thus reducing the deformation amount thereof. Therefore, it is possible to accurately rock the camshaft support member 23 with little error.

The rocking drive mechanism D is supported by the cylinder block 2. The head cover 4 can be floatingly supported by the cylinder head 3, thus preventing noise transmission from the head cover 4 to the outside through the rocking drive mechanism D.

In FIG. 1, a potentiometer 46 is attached to the right side surface of the cylinder head 3 for detecting a rocking angle of the camshaft support member 23. The potentiometer 46 is provided so as to be coaxial with the rocking axis 0 of the camshaft support member 23, and is connected to the camshaft support member 23 by engagement of the extreme end of the arm 47 extending from the input shaft thereof with the side plate 30. Thus, by directly connecting the potentiometer 46 to the camshaft support member 23, it is possible to accurately detect the rocking angle of the camshaft support member 23.

In FIG. 1, the intake cam gear 32*a* is composed of a fixed gear 28*a* and a movable gear 50*a* supported by the fixed gear 48*a* through the pin 49 in such a manner as to be slightly rotatable. The fixed gear 48*a* and movable gear 50*a* are energized by the coil spring 51 such that the tips thereof are deviated in the circumferential direction, thereby eliminating backlash between the intake cam gear 32*a* and the idler gear 31 meshed therewith.

Next, there will be described the function of the embodiments having the above-mentioned construction.

With operation of the internal combustion engine E, rotation of the idler gear 31 interlocked with the crankshaft is transmitted to a pair of camshafts 28*a* and 28*b* through a pair of cam gears 32*a* and 32*b*, thus driving the camshafts 28*a* and 28*b* at a rotational speed half as fast as that of the crankshaft. The rocker arms 13*a* and 13*b* abutting on the cams 34*a* and 34*b* rotating together with the camshafts 28*a* and 28*b* are rocked around the rocker arm shafts 16*a* and 16*b*, so that the intake valves 7*a* and the exhaust valves 7*b* pushed by the rocker arms 13*a* and 13*b* are opened one time per two rotations of the crankshaft. In this case, the intake cam 34*a* and exhaust cam 34*b* are rotated clockwise as shown in FIG. 3; but the phase of the exhaust cam 34*b* is advanced ahead of the intake cam 34*a* by approximately 90°. Consequently, at first, there occurs the valve opening period of the exhaust valves 7*b*, and sequentially there occurs the valve opening period of the intake valves 7*a*. Further, the valve opening period of the exhaust valves 7*b* is slightly overlapped with that of the intake valves 7*a*, thus forming a valve overlapping period between the exhaust valves 7*b* and intake valves 7*a*.

Figure 7:
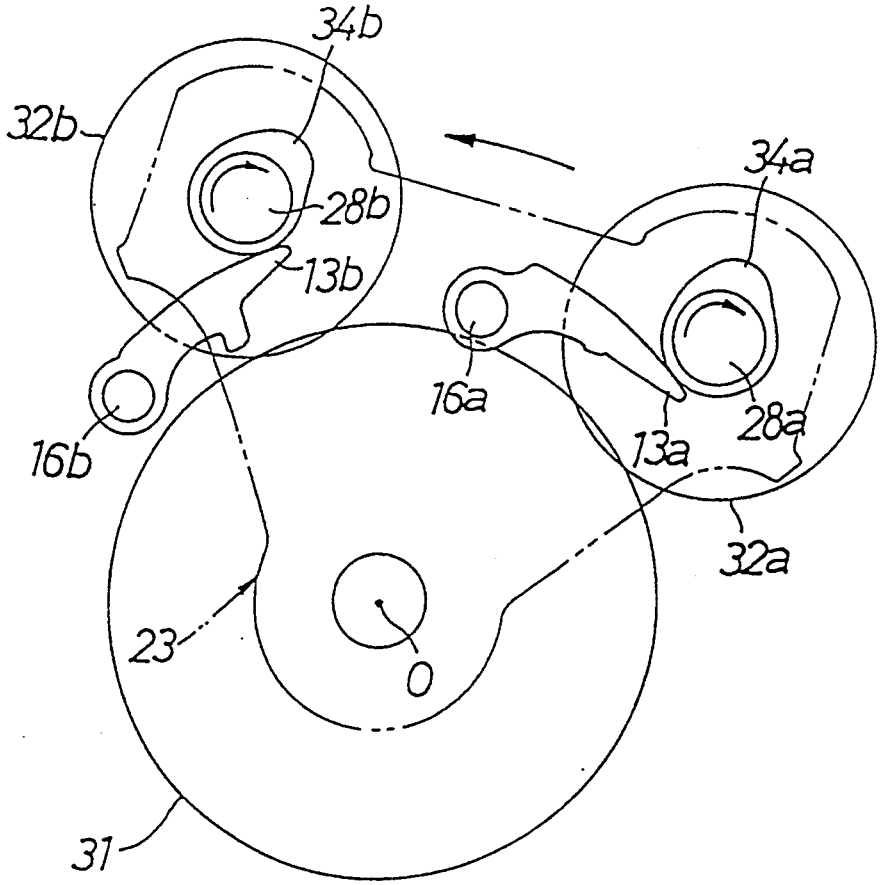
FIG. 7 is a schematic side view of the cam drive in a first position.

As shown in FIG. 7, when the internal combustion engine E is operated in a low speed region, the camshaft support member 23 lies in a state of being rocked clockwise, and the cams 34*a* and 34*b* are respectively brought in contact with the extreme end sides (right side in FIG. 7) of the rocker arms 13*a* and 13*b*. In this state, the distances between the rocker arm shafts 16*a* and 16*b* and the contact points of the cams 34 and 34*b* with the rocker arms 13*a* and 13*b* becomes larger. This reduces the rocking angles of the rocker arms 13*a* and 13*b*, resulting in reduced valve lifts of the intake valves 7*a* and exhaust valves 7*b*.

Figure 8:
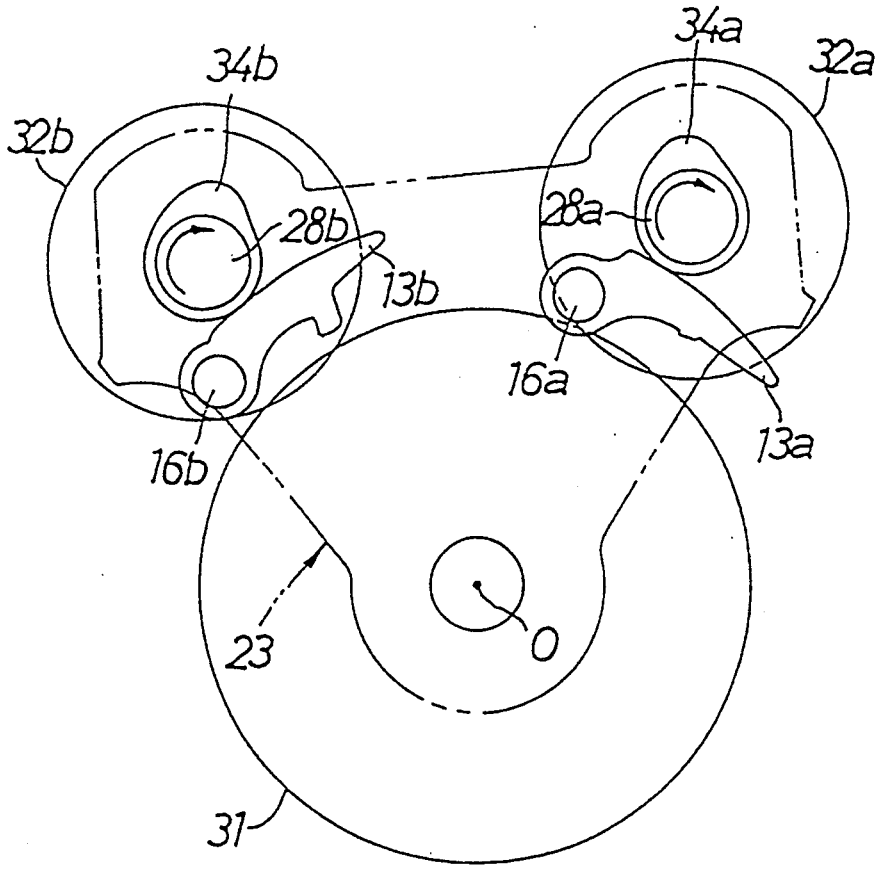
FIG. 8 is a schematic side view of the cam drive in a second position.

A sensor (not shown) detects increases in engine speed of the internal combustion engine E. This sensed increase results in actuation of the servomotor to drive the camshaft support member 23 counterclockwise to the position as shown in FIG. 8 around the rocking axis 0. The camshaft support member 23 is driven through the worm gear 36 and sector gear 35. The intake camshaft 28*a* and exhaust camshaft 28*b* installed on the camshaft support member 23 are integrally rocked, which causes the contact points between the cams 34*a* and 34*b* and the rocker arms 13*a* and 13*b* to move toward the rocker arm shafts 16*a* and 16*b*. This enlarges the rocking angles of the rocker arms 13*a* and 13*b* thus increasing the valve lifts of the intake valves 7*a* and 7*b* and further increasing the time and area widths of the valve overlap period compared with a low speed region. At the same time, by counterclockwise rocking of the camshaft support member 23, the intake cam gear 32*a* and exhaust cam gear 32*b* meshed with the idler gear 31 are slightly rotated counterclockwise, that is, in the direction reversed to that of the rotation of the camshafts 28*a* and 28*b*. Accordingly, the phase angles of the intake cam 34*a* and exhaust cam 34*b* are changed resulting in a delay in valve timing.

As described above, in a low speed region, the valve lift is reduced and consequently the valve opening speed is lowered. This makes the blow down of exhaust gas slow thereby resulting in a decrease in exhaust noise, and also reducing the face pressure of the contact portions between the cams 34*a* and 34*b*, and the rocker arms 13*a* and 13*b* thereby making lubrication easier. Further, since the time and area widths of the valve overlapping period in a low speed region can be reduced, it is possible to reduce the amount of new gas passing through from an intake port 6*a* to an exhaust port 6*b* to reduce harmful components in exhaust gas, and to reduce the wrap-around of the exhaust pressure wave to the intake system for preventing noise.

Meanwhile, in a high speed region, the valve timing of the intake valve 7*a* can be delayed compared with a low speed region. Consequently, it is possible to enlarge a synchronous rotational region where the intake inertia effect is achieved and hence to obtain a flat torque characteristic and high output.

Tappet clearances between the cams 34*a* and 34*b*, and rocker arms 13*a* and 13*b* are respectively adjustable by rotation of the rocker arm shafts 16*a* and 16*b* composed of the eccentric shafts. This will be explained regarding the case of the intake rocker arm 13*a* with reference to FIGS. 4 and 5.

The camshaft support member 23 is rocked so as to make the intake side cam 34*a* opposed to the slipper arm $13a_2$ of the intake side rocker arm 13*a* directly over the intake valves 7*a*, and thus the suitable tappet clearance is obtained by shim adjustment of the intake valves 7*a*. Subsequently, the camshaft support member 23 is rocked so as to move the intake side cam 34*a* most closely to the rocker arm shaft 16*a*. In this state, for obtaining the same tappet clearance as mentioned above, the rocker arm shaft 16*a* is rotated to thereby adjust the height of the boss portion $13_1$ of the rocker arm 13*a*. In this case, the rotation of the rocker arm shaft 16*a* is carried out in the following manner: namely, the rocker arm shaft 16*a* is energized in the direction of the arrow A as shown in FIG. 5, that is, in the direction of lowering the eccentric portion $16_3$ for increasing the tappet clearance, thereby rotating the rocker arm shaft 16*a* by means of the energizing force of the coil spring 17*a* in the direction of the arrow A while loosening one adjusting bolt 18*a*, and then stopping it until the tappet clearance reaches the suitable value. Next, the other adjusting bolt 16*a* is tightened, thus allowing the extreme ends of the adjusting bolts 18*a* and 18*b* to be abutted on the cutouts $16a_4$ and $16a_5$ of the large diameter portion $16a_2$ of the rocker arm shaft 16*a*, to thus rock the rocker arm shaft 16*a*. Therefore, it is possible to accurately position the circular arc face of the slipper arm $13a_2$ of the rocker arm 13*a* at the suitable position around the rocking axis 0, and hence to adjust the tappet clearance over the rocker arm 13*a* to approximately a constant.

Thus, a rocking drive mechanism for rocking a camshaft support member around the rocking axis on the side opposed to the head cover with respect to the rocking axis is disclosed in this first embodiment whereby the head cover is not associated with a rocking drive mechanism and can, therefore, be floatingly supported on the upper portion of the cylinder head. This can prevent noise in the internal combustion engine from being transmitted to the head cover and to the outside. Further, the necessity for providing the rocking drive mechanism on the head cover can be eliminated which allows for a smaller head cover, thus reducing the height of the internal combustion engine.

Figure 9:
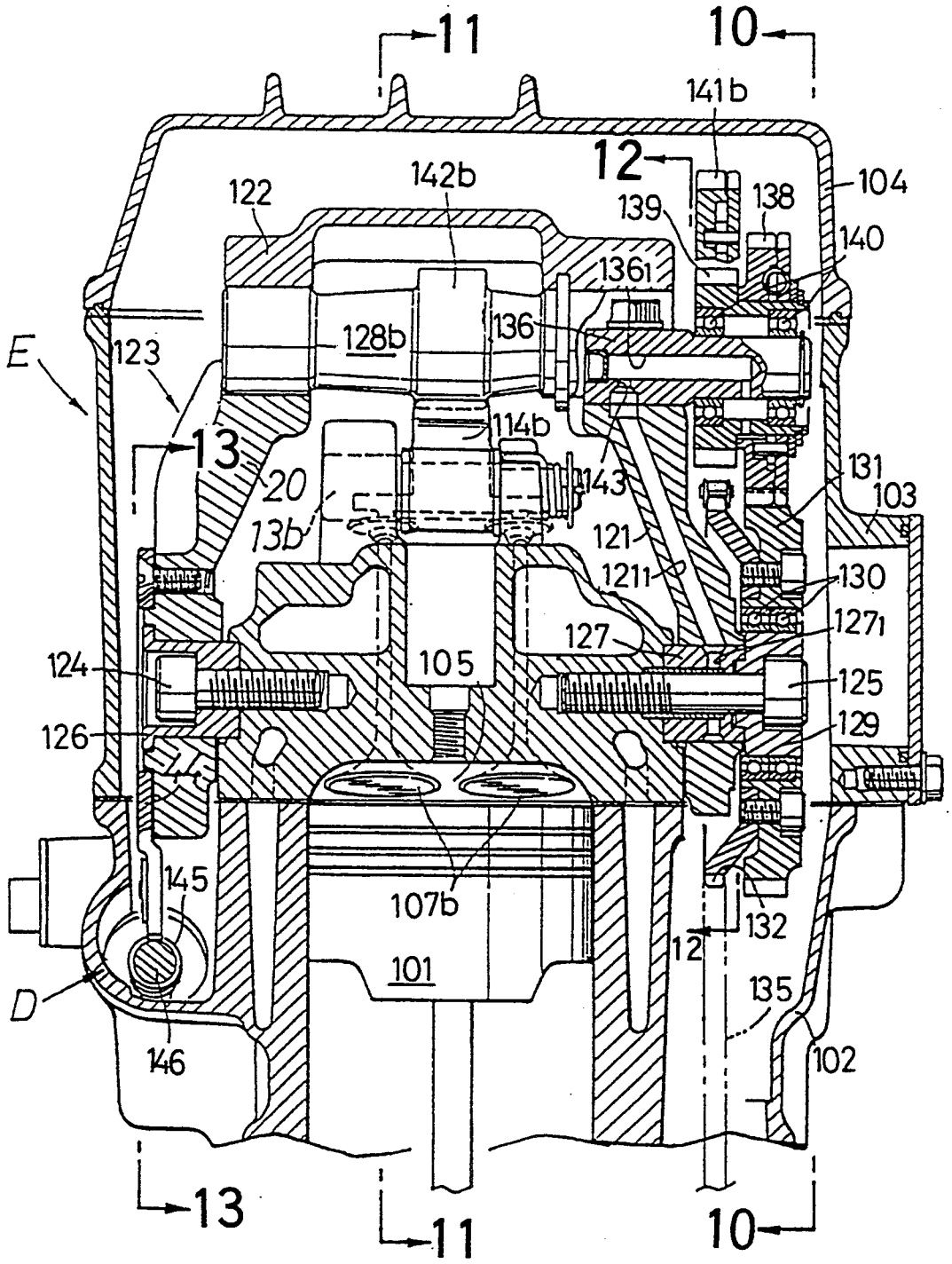
FIG. 9 is a longitudinal cross-sectional view of a cylinder head portion of an internal combustion engine of a second embodiment and is a cross-sectional view taken along line 9—9 of FIG. 10.
Figure 10:
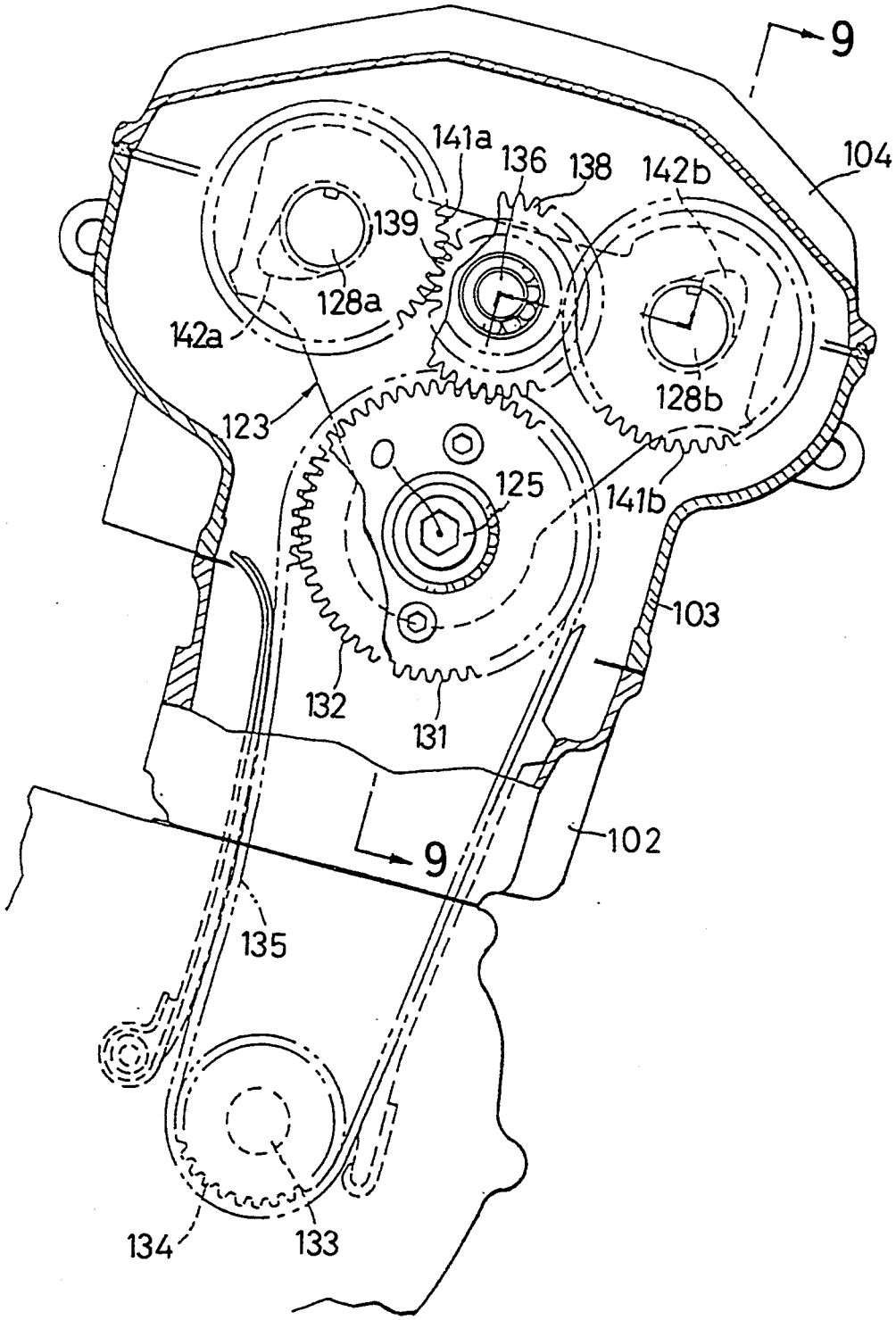
FIG. 10 is a cross-sectional view taken along line 10—10 of FIG. 9.
Figure 11:
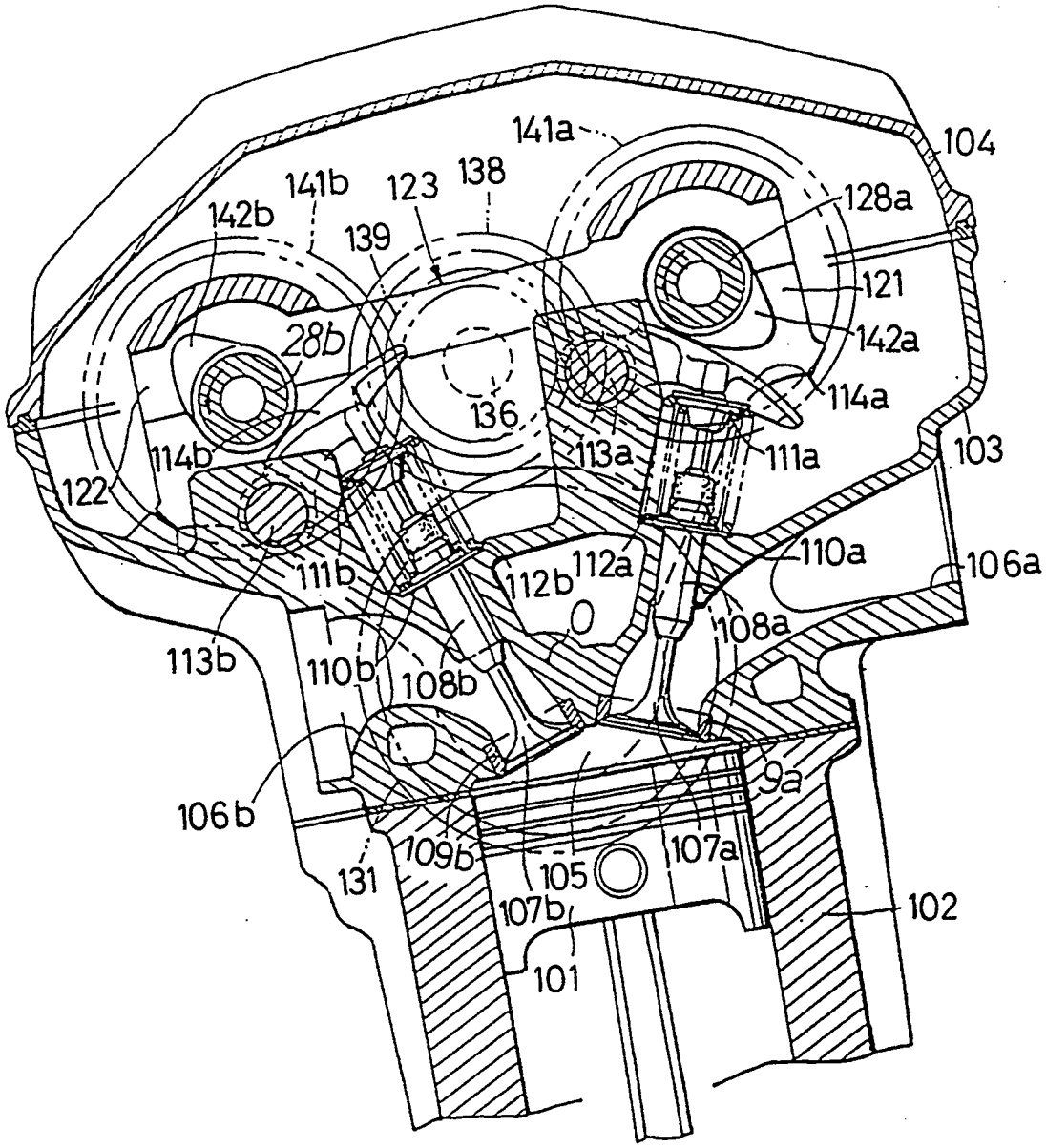
FIG. 11 is a cross-sectional view taken along line 11—11 of FIG. 9.

Referring now to FIGS. 9 to 11, a four-cycle internal combustion engine of double overhead camshaft type includes a cylinder head 103 joined onto the upper portion of a cylinder block 102 containing a slidable piston 101, and a head cover 104 joined onto the upper portion of the cylinder head 103.

The cylinder head 103 contains a combustion chamber 105 facing to the top of the piston 101. A pair of intake ports 106*a* and a pair of exhaust ports 106*b* opened to the combustion chamber 105 are mounted with intake valves 107*a* and exhaust valves 107*b*, respectively. The intake valves 107*a* and exhaust valves 107*b* are slidably supported by valve guides 108*a* and 108*b*, and are energized upwardly by valve springs 112*a* and 112*b* contractively positioned between upper retainers 110*a* and 110*b* and lower retainers 111*a* and 111*b* for seating the tappet portions of the valves 107*a* and 107*b* on valve seats 109*a* and 109*b*, respectively. With this arrangement, the upper ends of the shaft portions of the valves 107*a* and 107*b* abut against an intake rocker arm 114*a* and an exhaust rocker arm 114*b* rockably pivoted on the head cover 103 through rocker arm shafts 113*a* and 113*b*.

Figure 12:
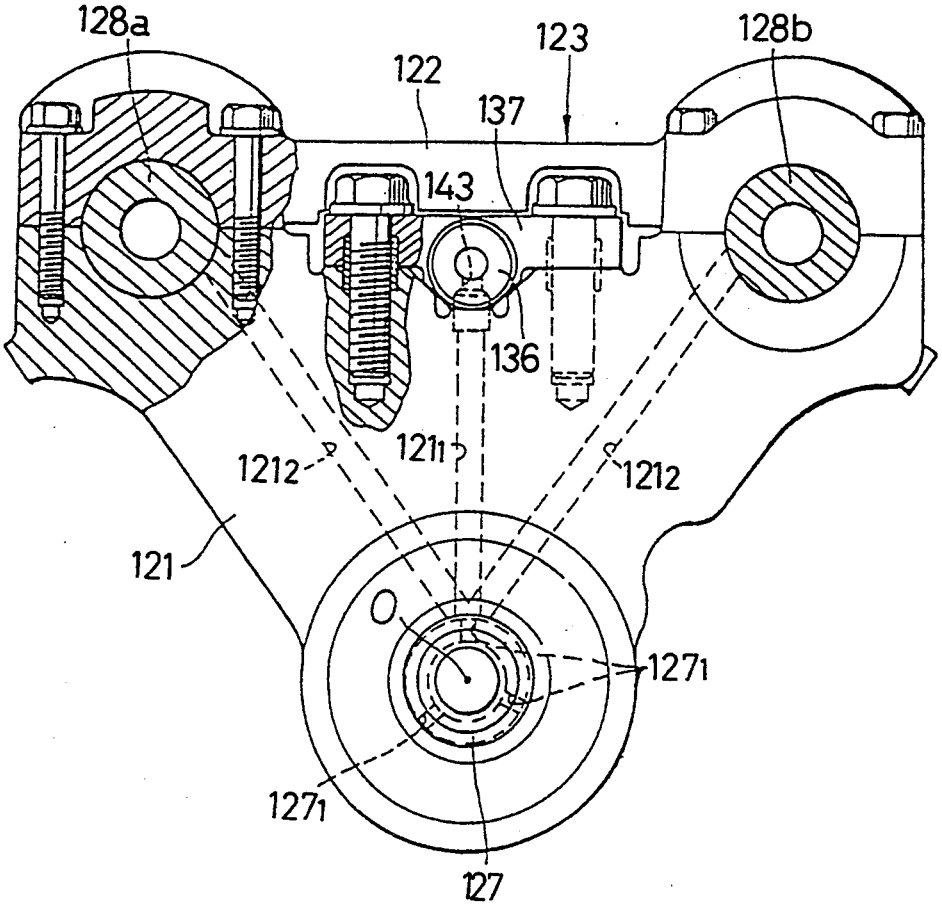
FIG. 12 is a cross-sectional view taken along line 12—12 of FIG. 9.

Referring further to FIG. 12, a camshaft support member 123 is composed of a pair of triangle side plates 120 and 121, and a cam holder 122 connecting the upper ends of the side plates 120 and 121 with each other. The lower ends of the camshaft support member 123 are rockably supported by boss members 126 and 127 fixed to the cylinder head 103 by bolts 124 and 125. An intake camshaft 128*a* and an exhaust camshaft 128*b* are rotatably installed between a pair of the side plates 120 and 121 of the camshaft support member 123, respectively.

An idler gear 131 is supported on a boss member 129 provided outside the boss member 127 so as to be coaxial therewith. A driven sprocket 132 provided integrally with the idler gear 131 is connected with a drive sprocket 134 provided on a crankshaft 133 through a chain 135. At the central portion of one side plate 121, a reduction gear shaft 136 is removably supported by a pushing member 137. First and second reduction gears 138 and 139 integrally rotated are supported around the outer periphery of the reduction gear 136 through a ball bearing 140. The first reduction gear 138 is meshed with the idler gear 131. The second reduction gear 139 is meshed with an intake cam gear 141*a* provided on the intake camshaft 128*a* and an exhaust cam gear 141*b* provided on the exhaust camshaft 128*b*. The reduction gear shaft 136 and both the reduction gears 138 and 139 are mounted through the upper opening of the cylinder head 103 after the camshaft support member 123 is mounted within the cylinder head 103.

The first reduction gear 138 is formed larger in diameter than the second reduction gear 139, so that the rotation of the idler gear 131 is transmitted in acceleration to the first reduction gear 138 while the rotation of the second reduction gear 139 is transmitted in deceleration to both the cam gears 141*a* and 141*b*. Finally, both the cam gears 141*a* and 141*b* are driven at one-half the speed of the crankshaft 133.

An intake cam 142*a* provided on the intake camshaft 128*a* is abutted on the intake rocker arm 114*a*, while a exhaust cam 142*b* provided on the exhaust camshaft 128*b* is abutted on the exhaust rocker arm 114*b* to thus open and close the intake valves 107*a* and exhaust valves 107*b*, respectively. In this case, each slipper surface of the rocker arms 114*a* and 114*b* is formed into a circular arc with respect to the rocking axis 0 of the camshaft support member 123, that is, the rotational center of the idler gear 131.

In FIG. 9, one side plate 121 has an upper portion inclined toward the centerline of the internal combustion engine E. The reduction gear shaft 136 and both the reduction gears 138 and 139 are disposed in a space formed outside the inclined side plate 121. This makes it possible to dispose the reduction gear shaft 136 and both the reduction gears 138 and 139 on the line upwardly extending from the chain 135 connecting the drive sprocket 134 with the driven sprocket 132, and hence to avoid increase in axial dimension of the internal combustion engine E effectively utilizing the internal space of the cylinder head 103.

In FIGS. 9 to 12, the boss member 127 for supporting the side plate 121 is formed with an oil passage $127_1$ connected to an oil pump (not shown). The oil passage $127_1$ is connected from an oil passage $121_1$ running through the interior of the side plate 121 to an oil passage $136_1$ formed within the reduction gear shaft 136 through an orifice 143. Oil supplied from the oil passage $136_1$ within the reduction gear shaft 136 to the outside lubricates the first and second reduction gears 138 and 139, the idler gear 131 meshed therewith, and both the cam gears 141*a* and 141*b*. Further, oil supplied to the oil passage $127_1$ of the boss member 127 lubricates the intake camshaft 128*a* and exhaust camshaft 128*b* through the other oil passage $121_2$ formed within the side plate 121.

In FIGS. 9 to 13, the rocking drive mechanism D for rocking the camshaft support member 123 around the rocking center 0 includes a sector gear 144 rigidly fixed outside the other side plate 120 of the camshaft support member 123. A worm gear shaft 146 having a worm gear 145 meshed with the sector gear 144 is supported within the cylinder block 102 through a pair of ball bearings 147. An output gear 148 provided on the end portion of the worm gear shaft 146 is meshed with a second intermediate gear 152 of an intermediate shaft 151 supported within a gear box 149 by means of a pair of ball bearings 150. A first intermediate gear 153 rotated integrally with the second intermediate gear 152 is meshed with a pinion 155 of a servomotor 154 provided outside the gear box 149.

When the servomotor 154 is driven, the rotation of the pinion 155 is transmitted to the sector gear 144 through the first intermediate gear 153, second intermediate gear 152, output gear 148, and worm gear 145. Thus, the camshaft support member 123 is rocked around the rocking center 100 to thereby change the valve timing and valve lift of the intake valves 107*a* and exhaust valves 107*b*.

There will be explained the construction of a rocking angle detecting mechanism S for detecting the rocking angle of the camshaft support member 123 rocked by the rocking drive mechanism D with reference to FIGS. 13 and 14. A potentiometer holder 156 is floatingly supported in a recessed portion $102_1$ provided on the outside surface of the cylinder block 102 through two O-rings 157. The potentiometer holder 156 is rotatably formed with an arm support shaft 158 and removably fixed with a potentiometer 159 by a bolt 160. The potentiometer 159 is connected with the base end of the arm support shaft 158 through a connecting shaft 161. One end of an arm 162 is rigidly fixed at the extreme end of the arm support shaft 158 projecting within the cylinder block 102, and a pin 163 planted on the sector gear 144 is engaged with a slit $162_1$ formed at the other end of the arm 162.

Figure 13:
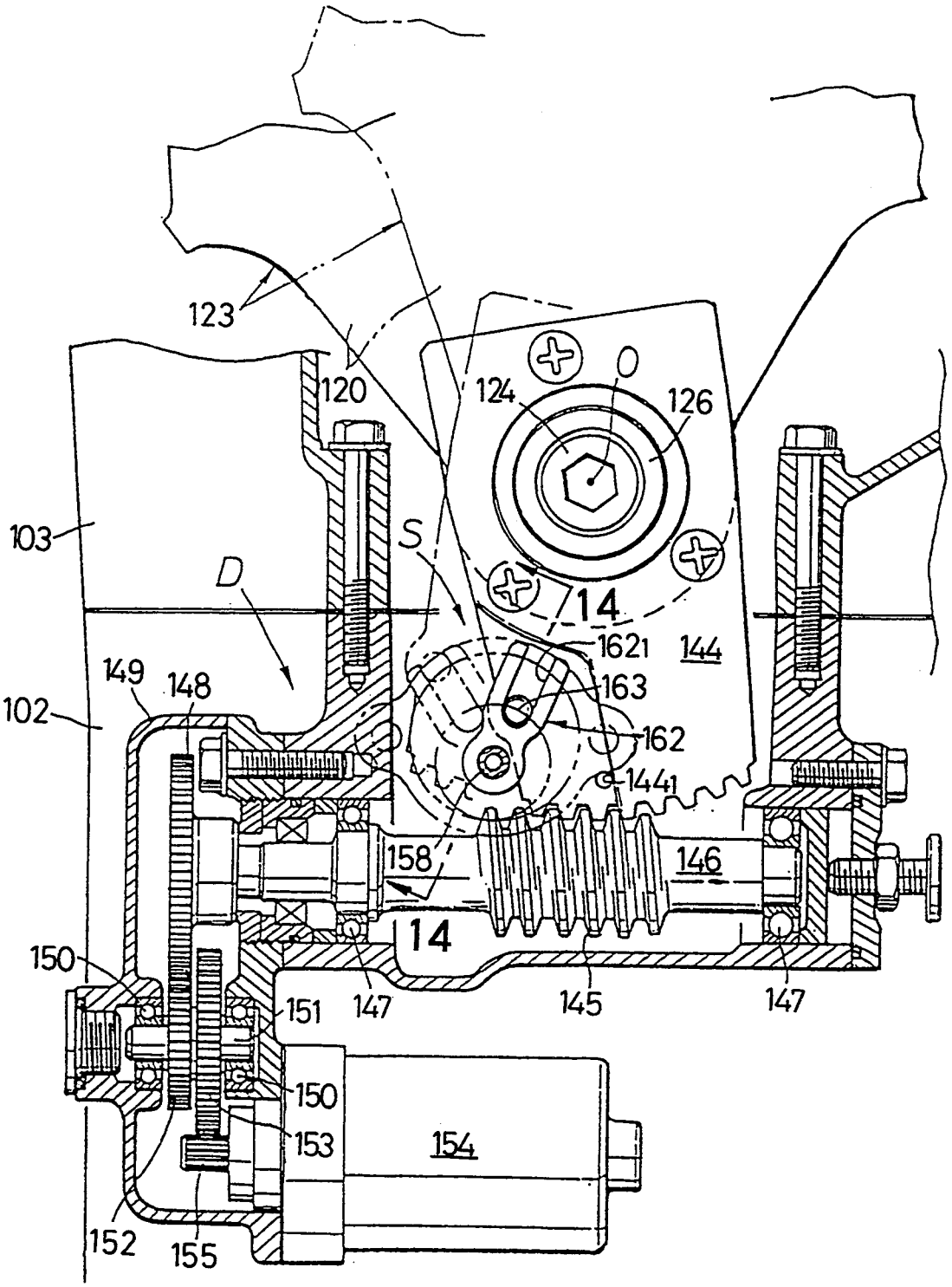
FIG. 13 is a cross-sectional view taken along line 13—13 of FIG. 9.
Figure 14:
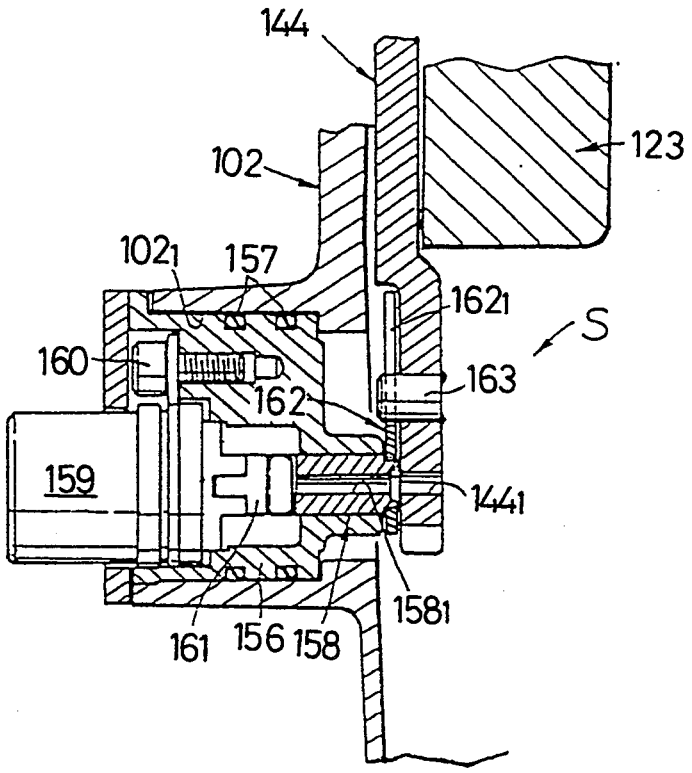
FIG. 14 is a cross-sectional view taken along line 14—14 of FIG. 13.

When the camshaft support member 123 is rocked to such a position as shown by a dotted line in FIG. 13, where the intake cam 142*a* and exhaust cam 142*b* are respectively separated from the rocker arm shafts 113*a* and 113*b* and thereby the valve lift is made smaller, the line connecting the rocking center 100 with the pin 163 of the sector gear 144 is intersected by the line connecting the arm support shaft 158 with the pin 163 at approximately 12°. As a result, the rotational angle of the arm support shaft 158 with respect to the rocking angle of the camshaft support member 123 is made smaller, thus decreasing the sensitivity of the potentiometer 159 connected with the arm supporting shaft 158. Meanwhile, when the camshaft support member 123 is rocked to such a position as shown in a solid line in FIG. 13, where the intake cam 142*a* and exhaust cam 142*b* are respectively close to the rocker arm shafts 13*a* and 13*b* and thereby the valve lift is made larger, the line connecting the rocking center 100 with the pin 163 of the sector gear 144 is nearly aligned to the line connecting the arm support shaft 158 with the pin 163. As a result, the rotational angle of the arm support shaft 158 with respect to the rocking angle of the camshaft support member 123 is made larger, thus enhancing the sensitivity of the potentiometer 159.

Figure 15:
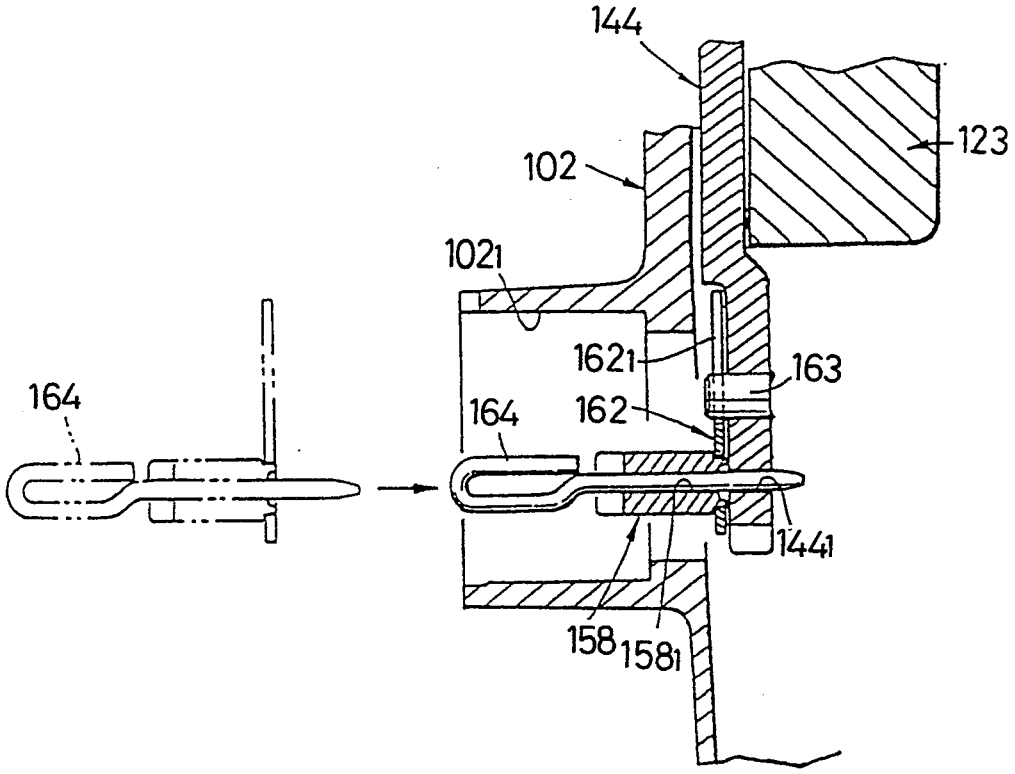
FIG. 15 is a side view in cross section explaining a potentiometer attachment process of the second embodiment.

The assembly of the above potentiometer 159 is carried out in the following manner. As shown in FIG. 15, the sector gear 144 is positioned around the rocking center 100 in such a manner that a set hole $144_1$ formed at the lower end of the sector gear 144 lies on the line extending from the input shaft of the potentiometer 159. Subsequently, a set pin 164 is inserted in a through-hole $158_1$ of the arm supporting shaft 158 integral with the arm 162, and is then inserted into the set hole $144_1$ while a slit $162_1$ of the arm 162 is engaged with the pin 163 of the sector gear 144.

Next, the potentiometer holder 156 is inserted into the recess portion $102_1$ with the head portion of the set pin 164 serving as a guide and fitted around the outer periphery of the arm supporting shaft 158. The set pin 164 is then pulled out with the arm supporting shaft 158 left behind. The potentiometer 159, being previously set with a connecting shaft 161, is inserted within the potentiometer holder 156. The connecting shaft 161 is connected with the arm support shaft 158. After that, the potentiometer 159 is fixed to the potentiometer holder 156 by the bolt 160. In this case, since the potentiometer holder 156 is supported in the recess portion $102_1$ of the cylinder block 102 through the two O-rings 157, vibration transmitted to the potentiometer 159 is reduced, thus improving the reliability of the potentiometer 159.

There will be described the function of the embodiment having the above construction.

The rotation of the idler gear 131 connected with the crankshaft 133 through the drive sprocket 134, the chain 135 and the driven sprocket 132 is transmitted to a pair of cam gears 141*a* and 141*b* through the first and second gears 138 and 139 of the reduction gear shaft 136 supported on the camshaft support member 123. A pair of camshafts 128*a* and 128*b* driven by the cam gears 141*a* and 141*b* are respectively rotated at one half the speed of the crankshaft. Then, the rocker arms 114*a* and 114*b* abutted on the intake cam 142*a* and exhaust cam 142*b* provided on the camshafts 128*a* and 128*b* are respectively rocked around the rocker arm shafts 113*a* and 113*b*. Consequently, the intake valves 107*a* and exhaust valves 107*b* pushed by the rocker arms 114*a* and 114*b* are respectively opened one time per two rotations of the crankshaft. In this case, the intake side cam 142*a* and exhaust cam 142*b* are rotated counterclockwise as shown in FIG. 3; but the phase of the exhaust cam 142*b* leads the intake side cam 142*a* by approximately 90°. Accordingly, at first, there occurs the valve opening period of the exhaust valves 107*b* and sequentially there occurs the valve opening period of the intake valves 107*a*. Further, the valve opening period of the exhaust valves 107*b* slightly overlaps that of the intake valves 107*a*, thus forming a valve overlap period between the exhaust valves 107*b* and intake valves 107*a*.

Figure 16A:
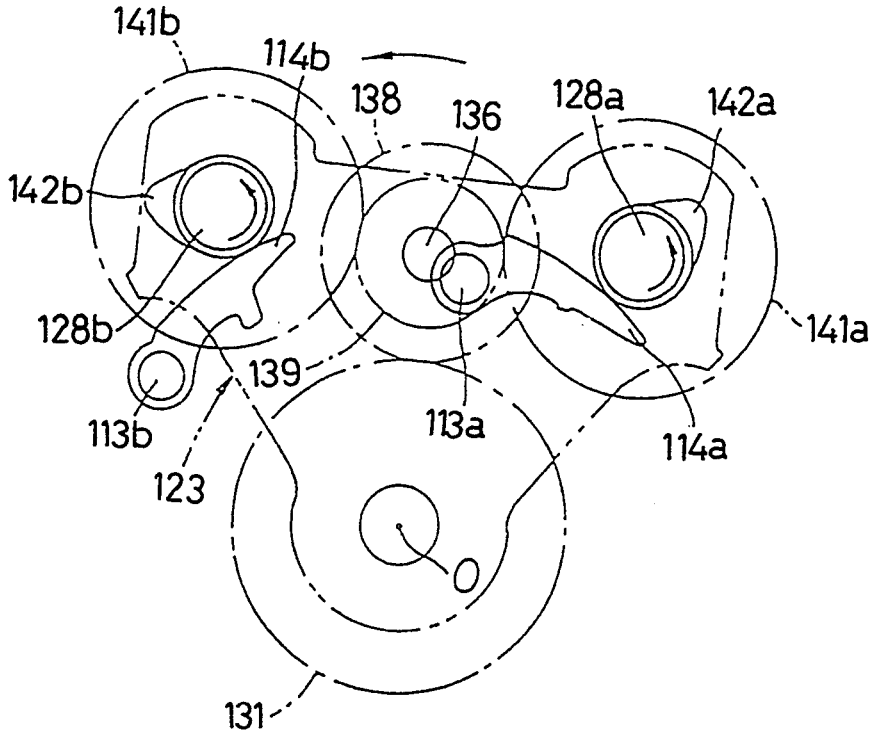
FIGS. 16(A) and (B) are schematic side views of the second embodiment illustrating two positions of the drive mechanism.
Figure 17:
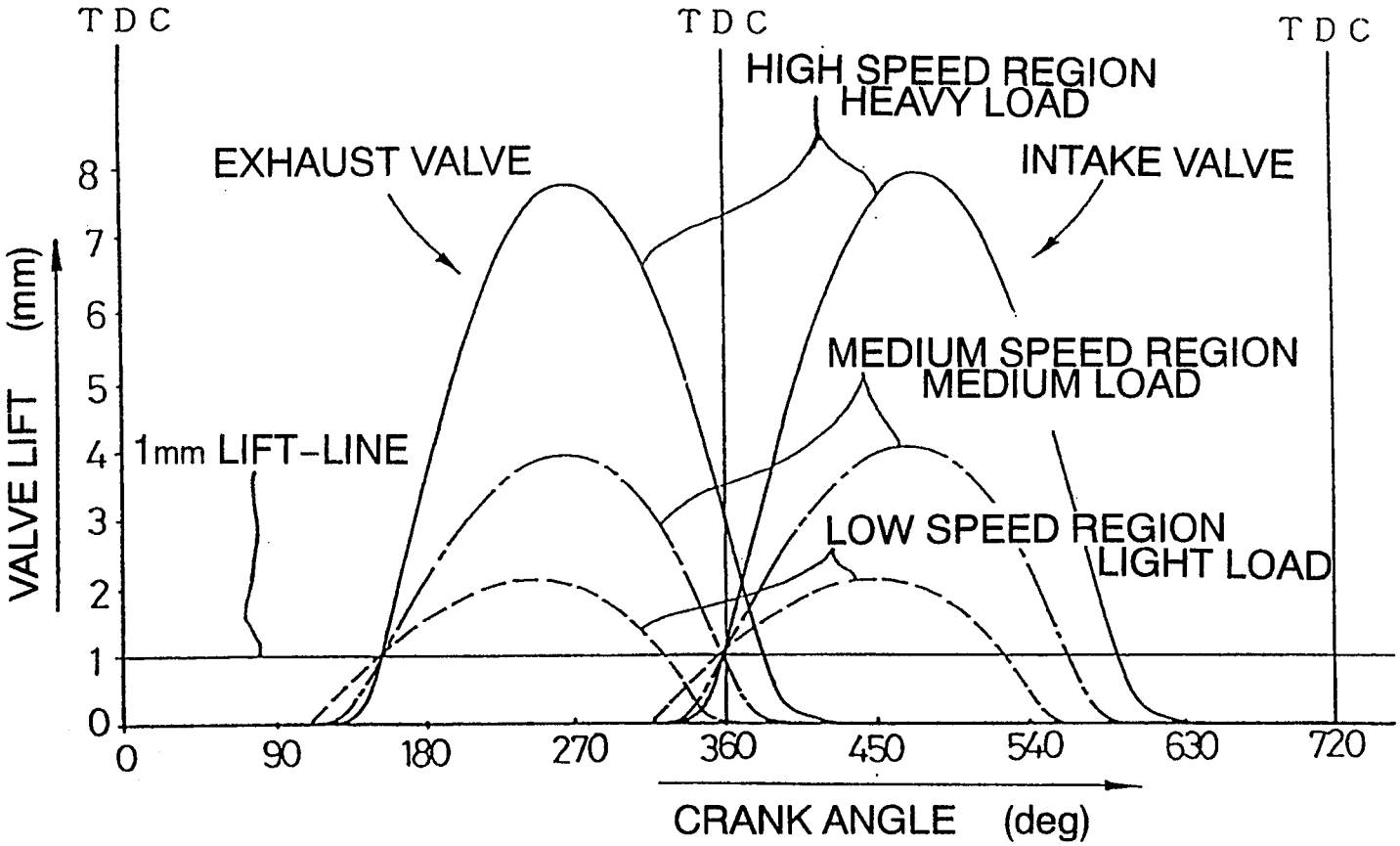
FIG. 17 is a graph showing the valve lift and valve timing of the second embodiment.

As shown in FIG. 16(A), when the internal combustion engine is operated in a low speed region, the camshaft support member 123 lies in a state of being rocked clockwise, and both the cams 142*a* and 142*b* are respectively brought in contact with the extreme end (right side in this Figure) of the rocker arms 114*a* and 114*b*. In this state, the distances between the rocker arm shafts 113*a* and 113*b* and the contact points of the cams 142*a* and 142*b* to the rocker arms 114*a* and 114*b* become larger. This reduces the rocking angles of the rocker arms 114*a* and 114*b*, resulting in the reduced valve lift of the intake valves 107*a* and exhaust valves 107*b* as shown in FIG. 17.

Figure 16B:
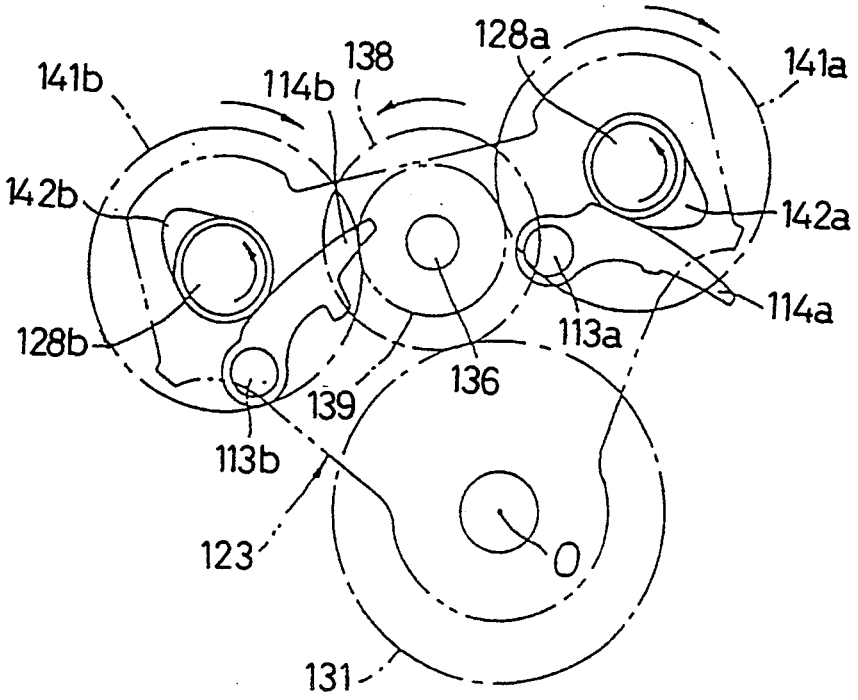

A sensor (not shown) detects increase in engine speed of the internal combustion engine E. Responsive to this, the camshaft support member 23 is rocked counterclockwise to the position (B) in FIG. 16 around the rocking axis 100 by the sector gear 144 meshed with the worm gear 145 driven by means of the servomotor 154. Then the intake camshaft 128*a* and exhaust camshaft 128*b* installed on the camshaft support member 123 are integrally rocked, which causes the contact points between the cams 142*a* and 142*b*, and the rocker arms 114*a* and 114*b* to move on the sides of the rocker arm shaft 113*a* and 113*b*, respectively. This enlarges the rocking angles of the rocker arms 114*a* and 114*b* thus increases the valve lifts of the intake valves 107*a* and 107*b*, and further increases the time and area widths of the valve lifts of the valve overlap period compared with a low speed region. At the same time, by counterclockwise rocking of the camshaft support member 123, the intake side cam gear 142*a* and exhaust cam gear 142*b* meshed with the idler gear 131 through the first and second reduction gears 138 and 139 are slightly rotated clockwise, that is, in the direction reversed to that of the rotation of the camshafts 128*a* and 128*b*. Accordingly, the phase angles of the intake cam 142*a* and exhaust cam 142*b* are delayed, resulting in a delay in valve timing (refer to FIG. 17).

As described above, in a low speed region, the valve lift is reduced and consequently the valve opening speed of the exhaust valve 107*b* is lowered. This makes the blow down of exhaust gas slow thereby enabling decrease in exhaust gas noise, and also reduces the face pressure of the contact portions between the cams 142*a* and 142*b* and rocker arms 114*a* and 114*b*, thereby facilitating lubrication. Further, since the time and area widths of the valve overlap period in a low speed region can be reduced, it is possible to reduce the volume of new gas passing through an intake port 106*a* to an exhaust port 106*b*, thereby reducing harmful components in exhaust gas, and to reduce the wrap-around of the exhaust pressure wave to the intake system for preventing noise.

In a high speed region, the valve closing timing of the intake valves 107*a* can be delayed compared with a low speed region. Consequently, it is possible to enlarge a synchronous rotational region where the intake inertia effect is achieved and a flat torque characteristic and high output can be obtained.

As described above, when the valve lift and valve timing are changed accompanied with rocking of the camshaft support member 123, the intake cam gear 141*a* and exhaust cam gear 141*b* are meshed with the idler gear 131 through a pair of reduction gears 138 and 139. Accordingly, by suitable selection of respective teeth numbers of the reduction gears 138 and 139, it is possible to control the valve lift and valve timing in a wide range. Further, with the diameters of the cam gears 141*a* and 141*b* reduced, a desired reduction ratio can be obtained by interposition of the reduction gears 141*a* and 141*b*. This makes it possible to reduce the inertia effect of the camshaft support member 123, thus lowering the load exerted on the servomotor 154.

Figure 18:
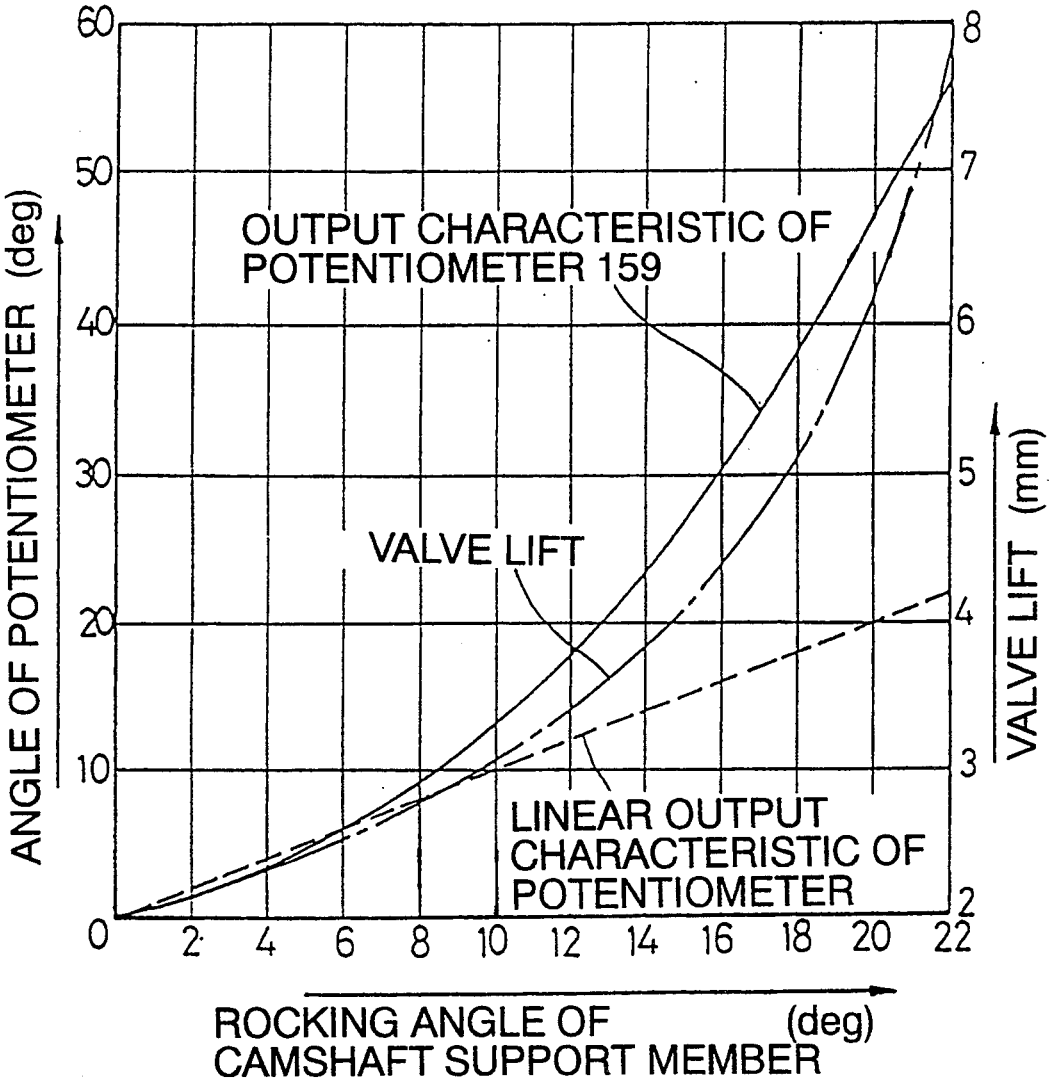
FIG. 18 is a graph showing an output characteristic of a potentiometer associated with the second embodiment.

When the camshaft support member 123 is rocked by the servomotor 154, the rocking angle of the camshaft support member 123 is detected by the potentiometer 159 and fed back to a controller. Meanwhile, depending on the positional relationship between the pin 163 provided on the sector gear 144 and the slit $162_1$ provided on the arm 162, when the valve lift is larger, the rotational angle of the potentiometer 159 is made larger, while when the valve lift is smaller, the rotational angle of the potentiometer 159 is made smaller. Namely, as shown in FIG. 18, when the rocking angle of the camshaft support member 123 is increased and thereby the valve lift is increased in a parabolic curve, the rotational angle is correspondingly increased in a parabolic curve. As a result, the output characteristic of the potentiometer 159 corresponds to the valve lift change characteristic, thereby enabling the rocking control of the camshaft support member 123 with accuracy.

As described above, the present invention is not limited to the embodiment but may be extended to various changes and modifications in design. For example, a relationship between rocking angle of the camshaft support member and output of the potentiometer is not limited to the embodiment but may be suitably determined as required. Also, rocking of the camshaft support member by means of the rocking drive mechanism is not necessarily electrically driven but may be hydraulically driven. Further, the means for transmitting the power from the crankshaft to the idler gear is not limited to the chain but may be a gear.

We claim:

1. A valve system for an internal combustion engine having a head, a cover on the head, a cylinder block and at least one valve, comprising a camshaft support member having a pivotal mounting to the head;

a camshaft rotatably mounted to said camshaft support member at a distance from said pivotal mounting;

a rocker arm pivotally mounted to the head and engaging the valve, said camshaft contacting said rocker arm;

a drive for said camshaft support member to move said camshaft support member about said pivotal mounting, said drive being mounted to one of the head and cylinder block of the engine.

2. The valve system of claim 1 wherein said camshaft support member includes a gear segment fixed to said camshaft support member.

3. The valve system of claim 2 wherein said drive includes a gear member mounted to one of the head and cylinder block and engaged with said gear segment.

4. The valve system of claim 3 wherein said gear member is a worm gear.

5. The valve system of claim 1 for an internal combustion engine having a plurality of valves, further comprising a plurality of said camshaft;

a plurality of said rocker arm.

6. A valve system of claim 1 wherein said drive is mounted to the cylinder block.

7. A valve system for an internal combustion engine having a head, a cylinder block and at least one valve, comprising a camshaft support member having a pivotal mounting to the head;

a camshaft rotatably mounted to said camshaft support member at a distance from said pivotal mounting;

a rocker arm pivotally mounted to the head and engaging the valve, said camshaft contacting said rocker arm;

a drive for said camshaft support member to move said camshaft support member about said pivotal mounting, said drive being mounted to the engine;

a position sensor coupled with said camshaft support member to sense position of said camshaft support member about said pivotal mounting;

a pin and slot linkage coupling the engine with said position sensor to have the output of said position sensor approximate valve lift.

8. The valve system of claim 7 wherein said pin and slot linkage includes a pin fixed to said camshaft support member and a slot pivotally mounted to the engine.

9. The valve system of claim 7 wherein said position sensor is a potentiometer.

10. A valve system for an internal combustion engine having a head, a cylinder block and at least one valve, comprising a camshaft support member having a pivotal mounting to the head;

a camshaft rotatably mounted to said camshaft support member at a distance from said pivotal mounting;

a rocker arm pivotally mounted to the head and engaging the valve, said camshaft contacting said rocker arm;

a drive for said camshaft support member to move said camshaft support member about said pivotal mounting;

a cam drive including an idler gear rotatably mounted about said pivotal mounting, a cam gear fixed to said camshaft and reduction gears between said idler gear and said cam gear.

11. The valve system of claim 10 further comprising a potentiometer coupled with said camshaft support member to sense position of said camshaft support member about said pivotal mounting.

12. The valve system of claim 11 further comprising a pin and slot linkage coupling the engine with said potentiometer to have the output of said potentiometer approximate valve lift.

13. The valve system of claim 12 wherein said pin and slot linkage includes a pin fixed to said camshaft support member and a slot pivotally mounted to the engine.

14. A valve system of claim 9 wherein said drive is mounted to one of the head and the cylinder block.

15. The valve system of claim 10 for an internal combustion engine having a plurality of valves, further comprising a plurality of said camshaft;

a plurality of said rocker arm;

said cam drive further including a plurality of said cam gear, each fixed to a said camshafts, respectively, said reduction gears engaging said plurality of said cam gear.

16. A valve system for an internal combustion engine having a cylinder block a head and valves, comprising a camshaft support member having a pivotal mounting to the head and including a gear segment fixed thereto;

camshafts rotatably mounted to said camshaft support member at a distance from said pivotal mounting;

rocker arms pivotally mounted to said head and engaging the valves, respectively, said camshafts contacting said rocker arms, respectively;

a drive for said camshaft support member to move said camshaft support member about said pivotal mounting, said drive being mounted to the cylinder block and including a worm gear mounted to the engine and engaged with said gear segment;

a cam drive including an idler gear rotatably mounted about said pivotal mounting, cam gears fixed to said camshafts, respectively, and reduction gears between said idler gear and said cam gears.

* * * * *